US006405377B1

(12) United States Patent
Davis

(10) Patent No.: US 6,405,377 B1
(45) Date of Patent: Jun. 18, 2002

(54) CONVERTIBLE JACKET

(75) Inventor: Gwennette Q. Davis, Rochester, NY (US)

(73) Assignee: Yoway Innovative Designs, Inc., Rochester, NY (US)

( * ) Notice: Subject to any disclaimer, the term of this patent is extended or adjusted under 35 U.S.C. 154(b) by 0 days.

(21) Appl. No.: 09/775,293

(22) Filed: Feb. 1, 2001

Related U.S. Application Data

(60) Provisional application No. 60/180,113, filed on Feb. 3, 2000.

(51) Int. Cl.[7] ..... A41D 1/02

(52) U.S. Cl. ..... 2/94; 2/69.5; 2/108

(58) Field of Search ..... 2/93, 69.5, 94, 2/69, 83–84, 86, 89, 108; 224/575–578, 580

(56) References Cited

U.S. PATENT DOCUMENTS 4,347,629 A * 9/1982 Itoi ..... 2/108
5,165,111 A * 11/1992 Lieberman ..... 2/94
5,815,833 A * 10/1998 Kuo ..... 2/69.5
5,860,164 A * 1/1999 Johnson ..... 2/94

* cited by examiner

*Primary Examiner*—John J. Calvert
*Assistant Examiner*—Tejash Patel
(74) *Attorney, Agent, or Firm*—Jaeckle Fleischmann & Mugel, LLP

(57) ABSTRACT

A garment includes a jacket portion and a bag portion. The jacket portion having a back side which includes an outer shell and an inner shell. A pocket is defined between a portion of the outer shell and the inner shell. The inner shell defines an orifice which provides access to the pocket. A fastener associated with the orifice is configured for selectively opening and closing the orifice. The bag portion is integral with the jacket portion, and is disposed within the pocket. The bag portion has flexible sides which define a bag opening. A fastener is associated with the bag opening and is configured for selectively providing access to an interior of the bag portion. The bag portion has a volume sufficient to store at least the jacket portion. The bag portion is configured to be removed from the pocket and turned inside out. The bag portion receives the jacket portion therein, thereby forming a duffel bag. At least one strap is attached to the interior of the bag portion and is disposed on an exterior of the bag portion after the bag portion has been turned inside out.

6 Claims, 9 Drawing Sheets

CONVERTIBLE JACKET

SUMMARY OF THE INVENTION

The present invention relates generally to outerwear, and more particularly to jackets which carry and are convertible into a tote bag or back-pack. This application claims priority of U.S. Provisional Ser. No. 60/180,113, filed Feb. 3, 2000.

BACKGROUND OF THE INVENTION

Convertible jackets, or jackets that are convertible to utilitarian articles such as tote bags, back-packs, or duffel bags, have proven to be generally unsatisfactory and unworkable in practice. Such garments are typically characterized by elaborate arrangements of buckles, snaps, complicated folding procedures, and other cumbersome procedures and devices which must be manipulated in order to convert the garment into the utilitarian article or vice versa. Furthermore, convertible jackets tend to be bulky, aesthetically unpleasing, and do not lend themselves to use as stylish or fashionable garments. Such jackets are typically poncho-type or loose-fitting garments which carry a large pouch and a plurality of fasteners that are plainly visible when the garment is worn as a jacket. These implements do not create an aesthetically pleasing or fashionable garment.

Therefore, what is needed in the art is a jacket which can be simply and easily converted into a back-pack, duffel bag or tote bag. Furthermore, what is needed in the art is such a jacket which substantially conceals the implements used in conversion and therefore creates a fashionable and aesthetically pleasing garment. Moreover, what is needed in the art is such a jacket which is lightweight and non-bulky.

BRIEF DESCRIPTION OF THE DRAWINGS

The above-mentioned and other features and advantages of this invention, and the manner of attaining them, will become appreciated and be more readily understood by reference to the following detailed description of several embodiments of the invention in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention in any manner.

DESCRIPTION OF THE INVENTION

The present invention provides outerwear which can be converted into various utilitarian items such as back packs, duffel bags, and tote bags.

The invention comprises, in one form thereof, a garment 10 which can be configured as a jacket or as a duffel bag.

Figure 1:
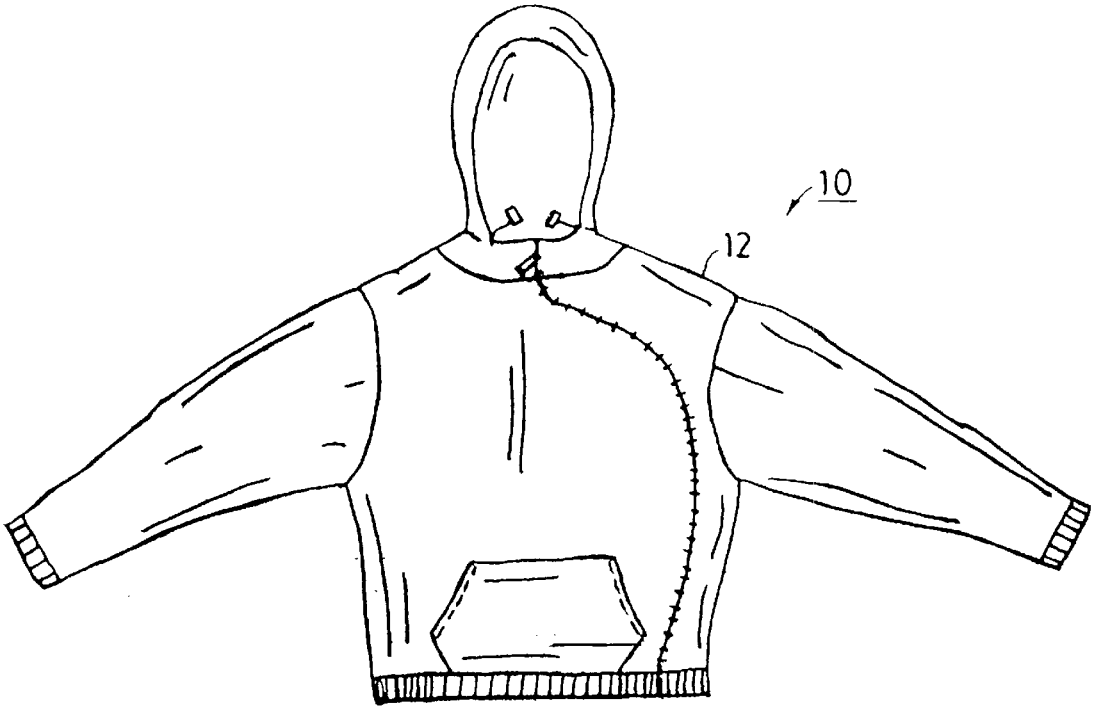
FIG. 1 is a front view of one embodiment of a convertible garment of the present invention.
Figure 2:
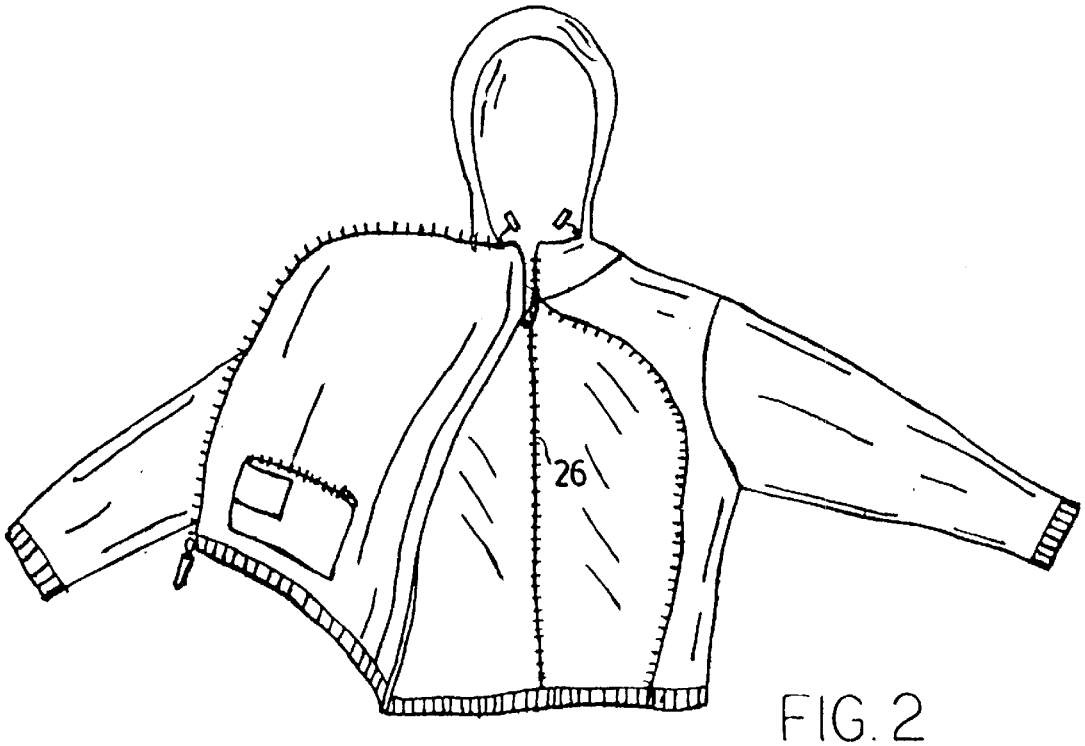
FIGS. 2–11 are perspective views of the convertible garment of FIG. 1 in various stages of being converted from a jacket to a duffel bag.
Figure 3:
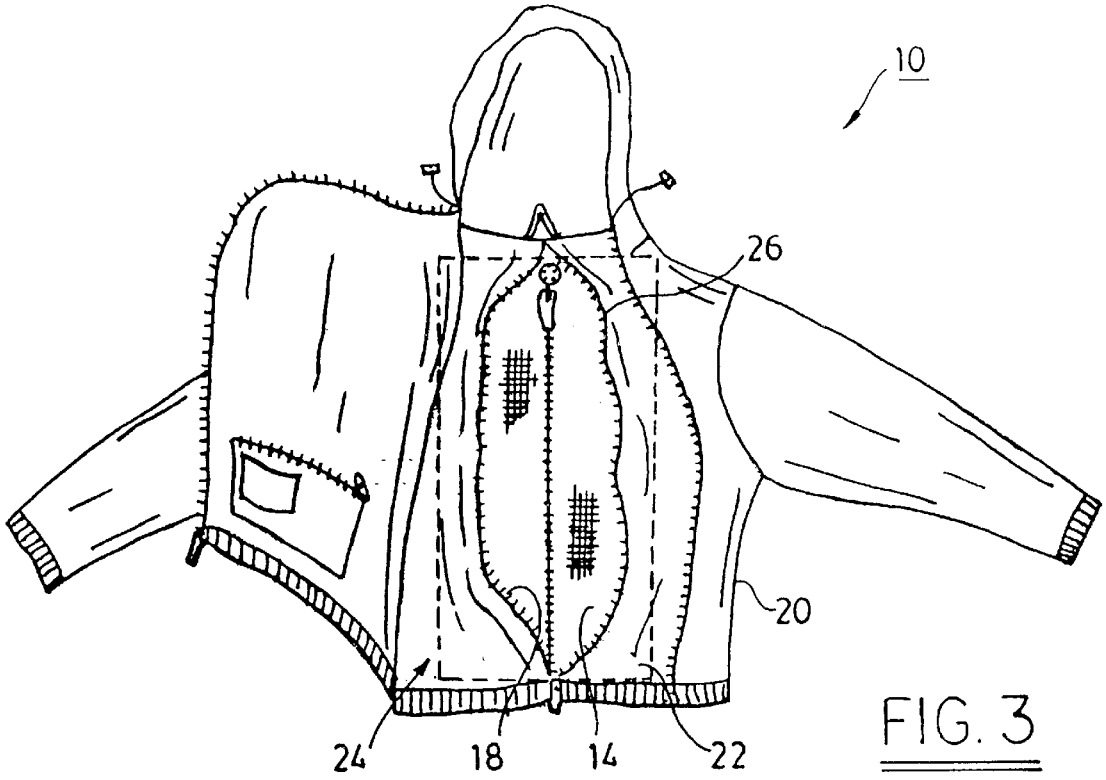
Figure 4:
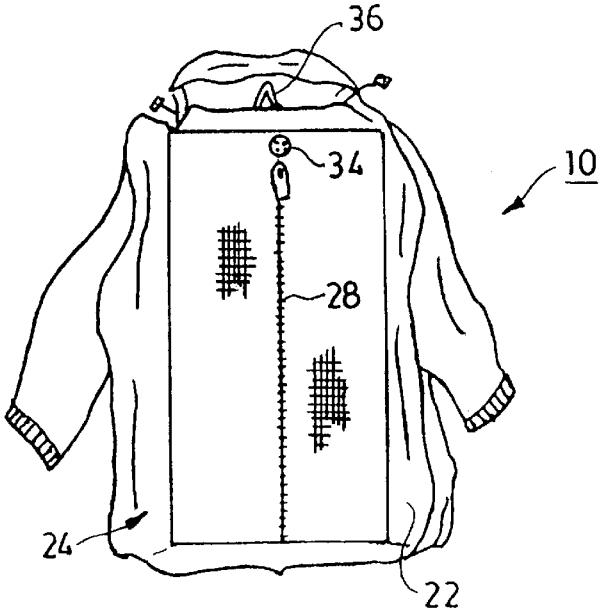
Figure 5:
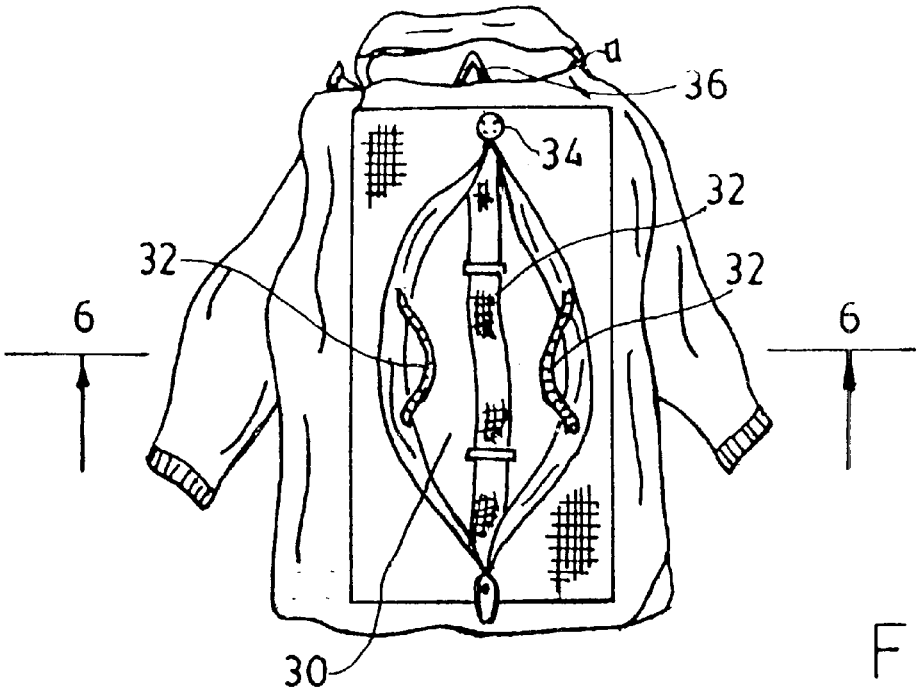
Figure 6:
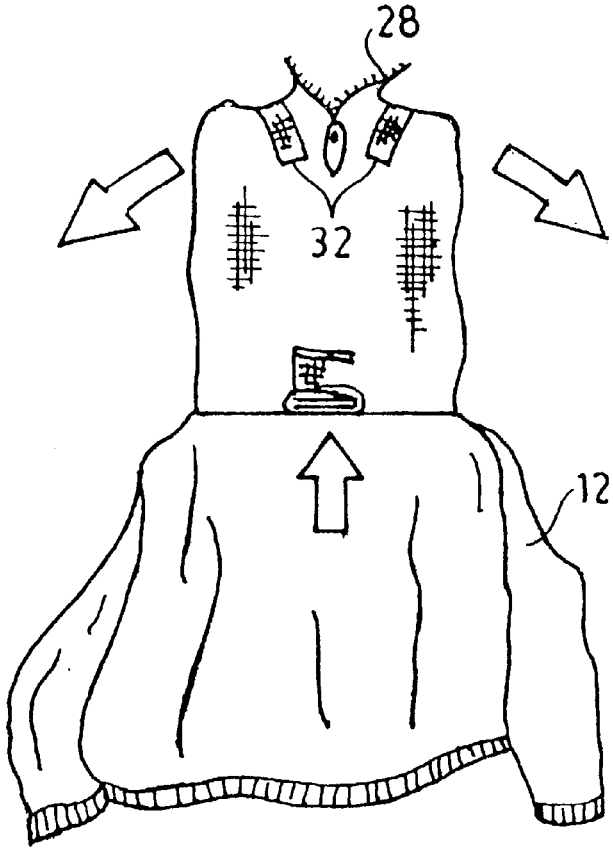
Figure 7:
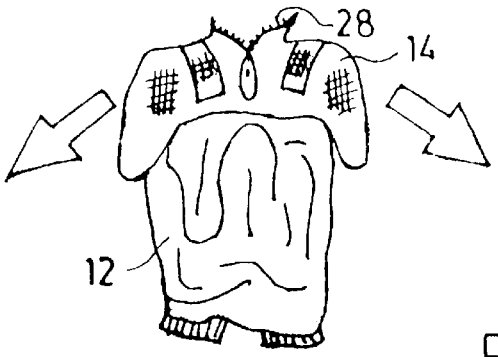
Figure 8:
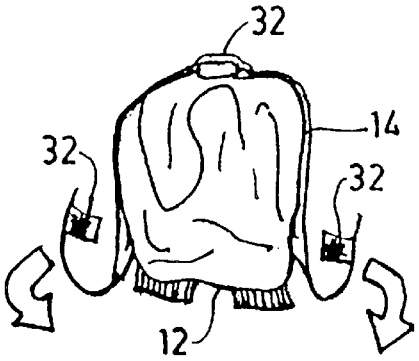
Figure 9:
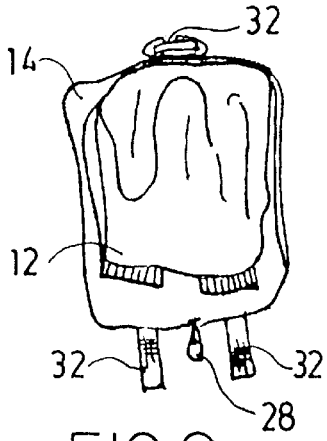
Figure 10:
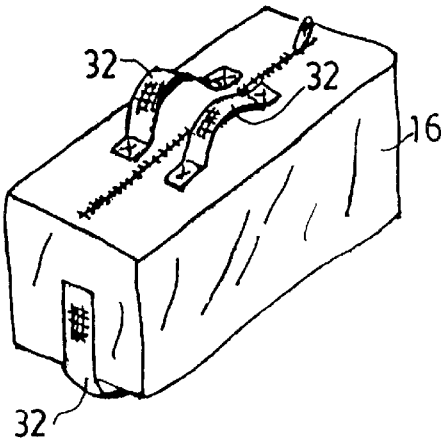
Figure 11:
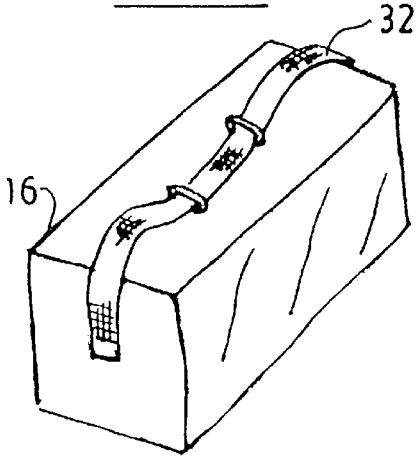
Figure 12:
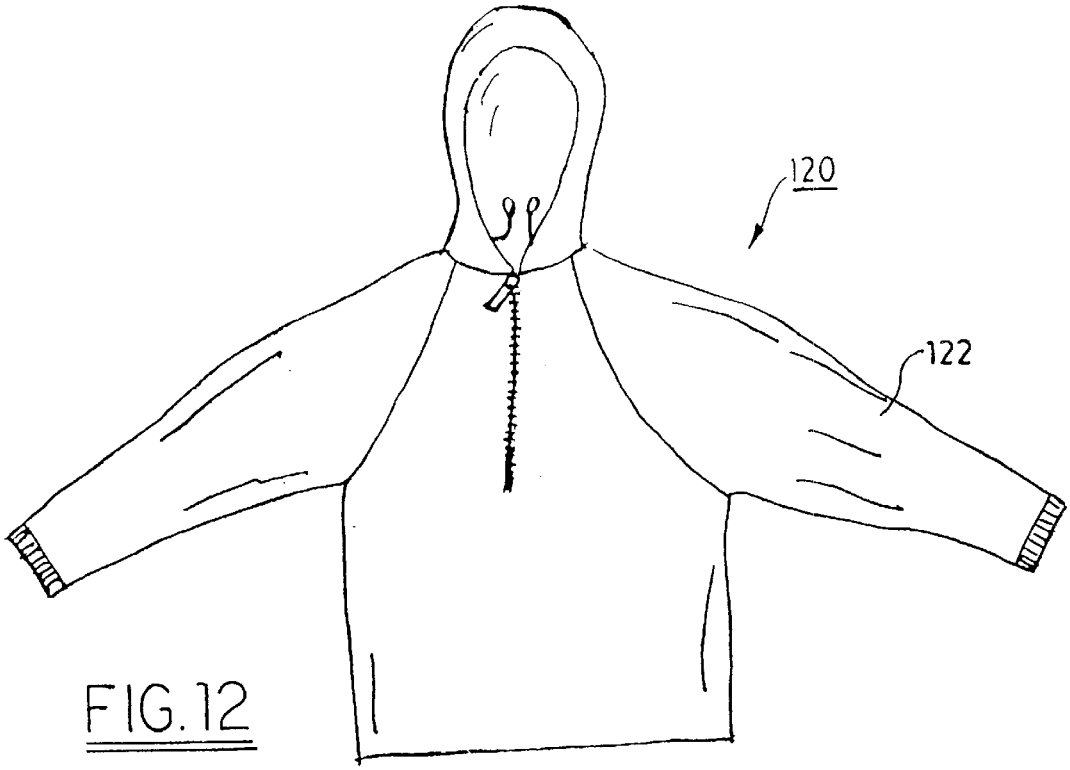
FIG. 12 is a front view of a second embodiment of a convertible garment of the present invention.

Garment 10 includes jacket portion 12 (FIG. 1) and duffel bag portion 14 (FIG. 3) integral with jacket portion 12. Jacket 10 is convertible into large duffel bag 16 (FIGS. 10 and 11). Jacket 10 includes a pocket 18 (FIG. 3) formed between outer shell 20 and inner shell 22 of the inside back portion 24 of jacket 10. When configured as a jacket, duffel bag 16 is carried and concealed entirely within pocket 16. Access to pocket 16, and thus duffel bag portion 14, is provided by zipper 26 disposed on inner shell 22 of back portion 24 of garment 10. To configured garment 10 as a duffel bag, zipper 26 is opened and then zipper 28 (FIG. 4) is opened as shown in FIG. 5, thereby providing access to interior 30 (FIG. 5) of duffel bag portion 14. Duffel bag portion 14 is then turned inside out (FIG. 6), and jacket portion 12 is folded into interior 30 (FIGS. 8 and 9). Thus, duffel bag 16 is formed. At least one carry strap 32 is attached to duffel bag portion 14. Button 34 (FIGS. 4 and 5) is attached to duffel bag portion 14 near the top of inner shell 22. To reconfigured duffel bag 16 for use as a jacket, zipper 28 is opened, and duffel bag 16 turned inside out. Duffel bag portion 14 is then neatly folded into pocket 18. Button 34 is then inserted into loop 36, thereby keeping duffel bag portion 14 neatly and flatly stored within pocket 16 when garment 10 is configured as a jacket. Zipper 26 is then closed, thereby concealing duffel bag portion 14 within pocket 16.

Figure 20:
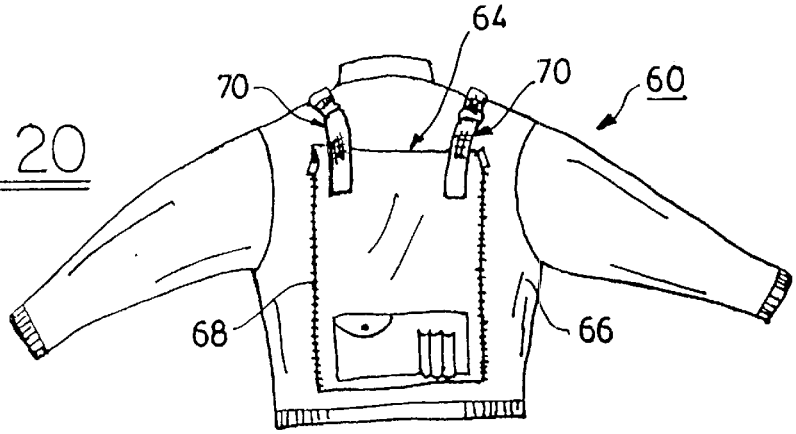
FIG. 20 is a rear view of the convertible garment of FIG. 19.
Figure 21:
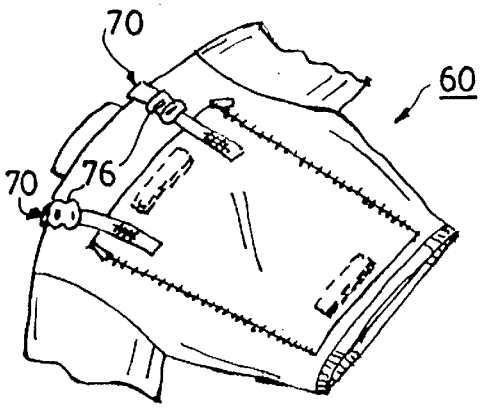
FIGS. 21–26 are perspective views of the garment of FIGS. 19 and 20 being converted to a discrete jacket and a discrete backpack.
Figure 22:
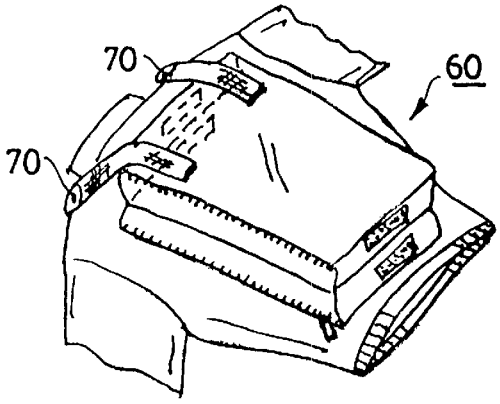
Figure 23:
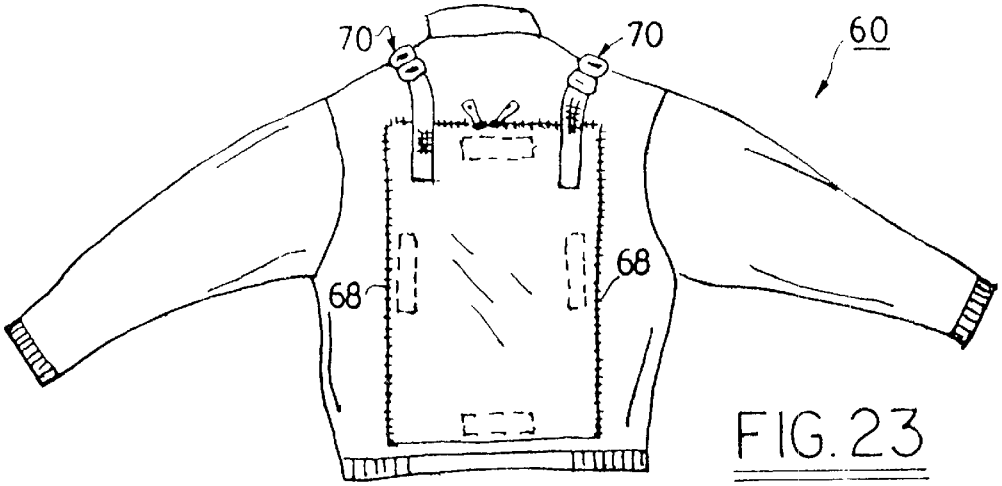
Figure 24:
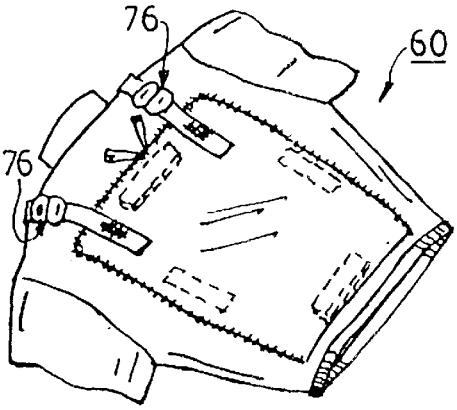

Referring now to FIGS. 19–26, garment 60 includes a jacket portion 62 and a back pack portion 64 (FIG. 20). Back pack portion 64 is attached to a back side 66 of jacket portion 62 by at least one zipper 68. Straps 70 each include a respective jacket strap 72 (FIG. 26) and a back pack strap 74 which can be selectively connected together by the use of buckles 76 (FIG. 24). Each one of buckles 76 includes a tongue 78 and a body 80 into which tongue 78 is removably secured, thereby selectively joining together each jacket strap 72 with a corresponding back pack strap 74. Each tongue 78 is attached to a first end of a respective jacket strap 72. A second end of each jacket strap 72 is attached to reinforced seam 84 (FIG. 19) in the front of garment 60. Intermediate the second end of each jacket strap 72 and reinforced seam 84, each jacket strap 72 may be attached by stitching 86 adjacent the shoulder area of jacket portion 62. Each body 80 is attached to a first end of a respective back pack strap 74. A second end of each back pack strap 74 is attached to back pack portion 64.

Figure 25:
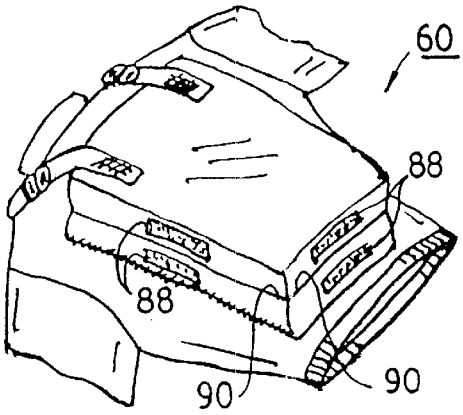
Figure 26:
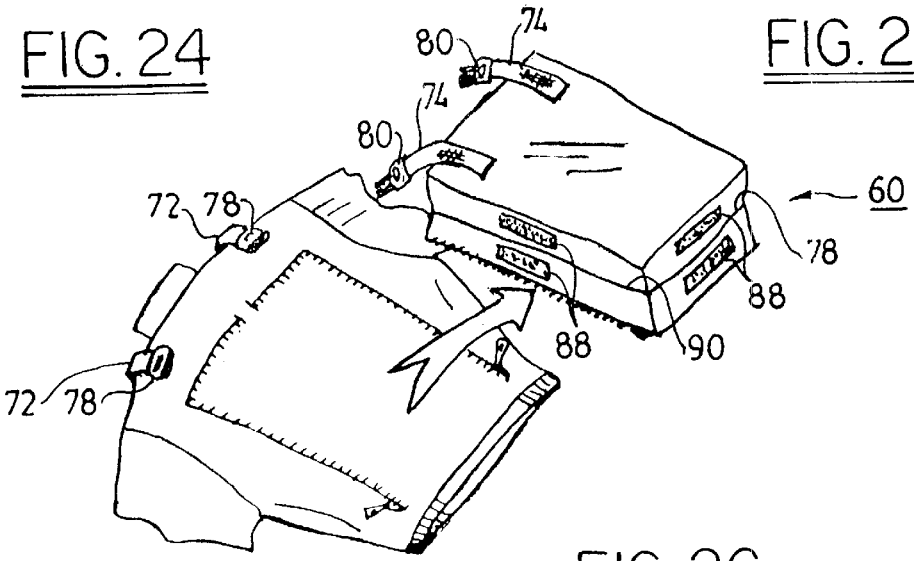

As shown in FIGS. 24–26, back pack portion 64 is detached from jacket portion 62 by operating zipper 68 and disconnecting each jacket strap 72 from a corresponding one of back pack straps 74 by operating each respective buckle 76. Back pack portion 64 can then be separated from jacket portion 62, as shown in FIG. 26. Back pack portion 64 is expanded by disengaging each of at least one strip of hook and loop fastener 88 (FIG. 25), which are attached to back pack portion 64 at folds 90 formed therein. Once back pack portion 64 is separated from jacket portion 62, each back pack strap 74 can be reconnected to a respective jacket strap 72 by a corresponding buckle 76. The arms of a user can be slipped through the loop formed by each jacket strap 72 between the reinforced seam 84 and stitching 86. Alternatively, jacket portion 62 can be folded and placed within back pack portion 64, and back pack portion 64 can be used without jacket portion 62. To reattach back pack portion 64 to jacket portion 62, zipper 68 is operated and back pack portion 64 is folded flat at folds 90. The strips of hook and loop fasteners 88 act to retain back pack portion 64 in its condensed form. Thus, back pack portion 64 remains folded in a flat and neat configuration, appearing to be an integral part of garment 60. The interior of back pack portion 64 is selectively accessed through a zipper (not shown) or other suitable closing device.

Figure 27:
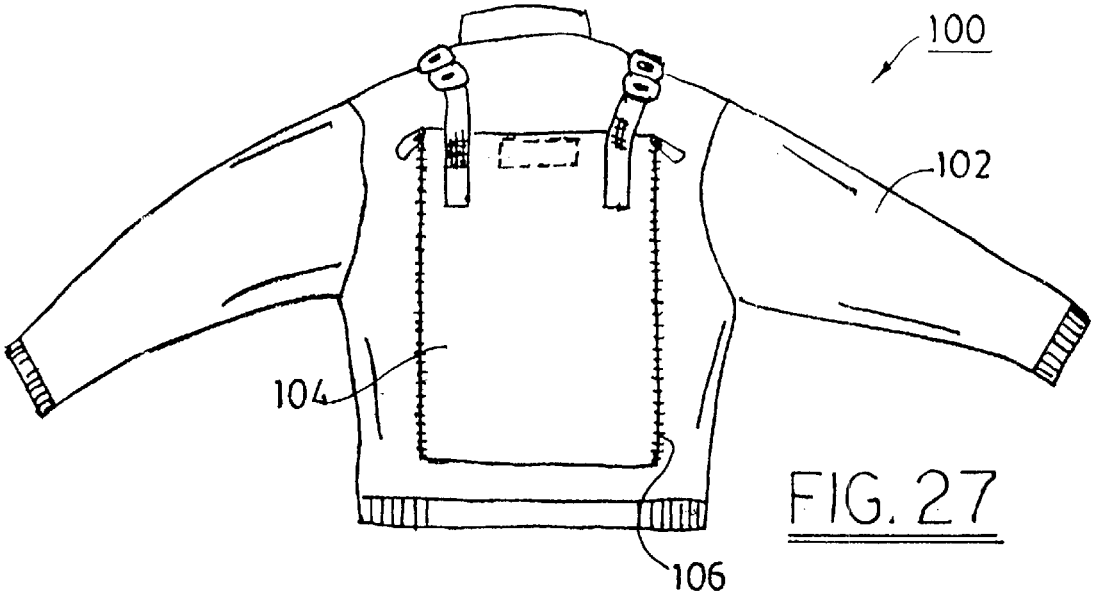
FIGS. 27 and 28 are perspective views of a fourth embodiment of a convertible garment of the present invention.
Figure 28:
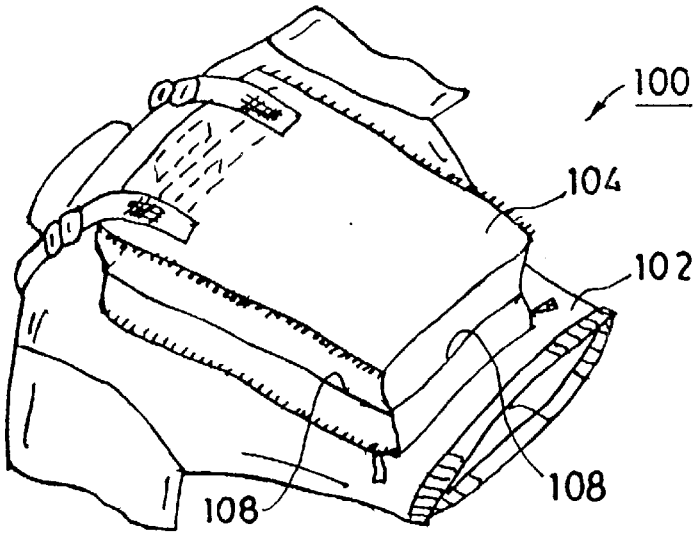

The invention comprises, in yet another form thereof, a garment 100 (FIG. 27) including a jacket portion 102 and a backpack portion 104. Garment 100 is substantially similar to garment 60, except that backpack portion 104 is integral with and permanently affixed to jacket portion 102, rather than being detachable. Zipper 106 allows for the backpack portion 104 to be selectively expanded into a use position, and retains backpack portion 104 when collapsed into a non-use, or storage position. Backpack portion 104 includes folds 108 (FIG. 28) formed therein which are utilized similar to folds 90 of garment 60, that is to enable backpack portion 104 to be neatly and flatly folded into a non-use or storage position.

Figure 13:
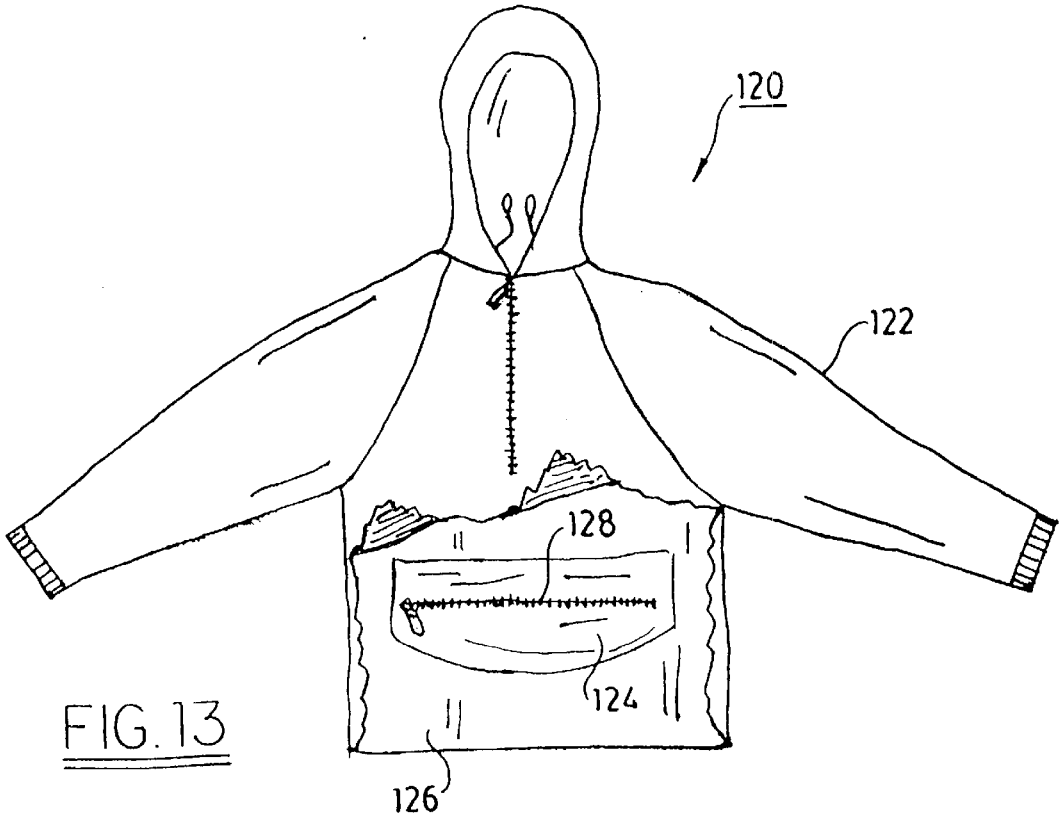
FIGS. 13–18 are perspective views of the convertible garment of FIG. 12 in various stages of being converted from a jacket to a duffel bag.
Figure 14:
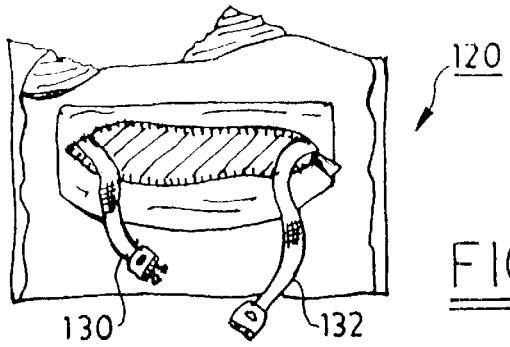
Figure 15:
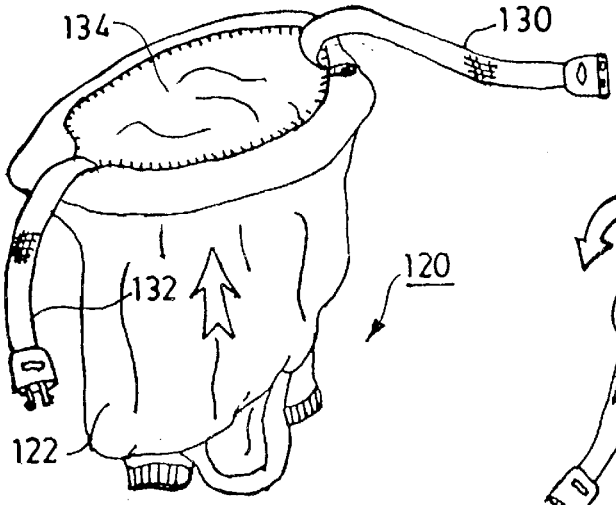
Figure 16:
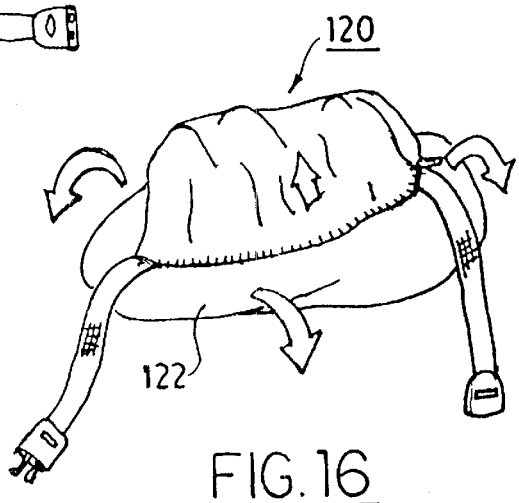
Figure 17:
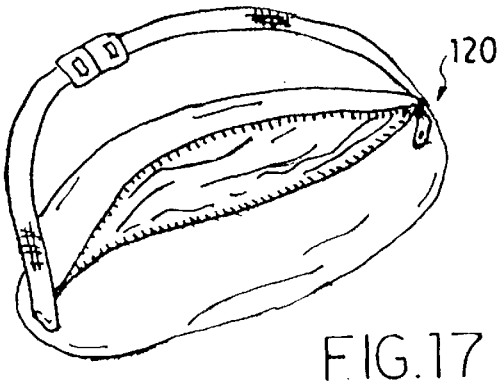
Figure 18:
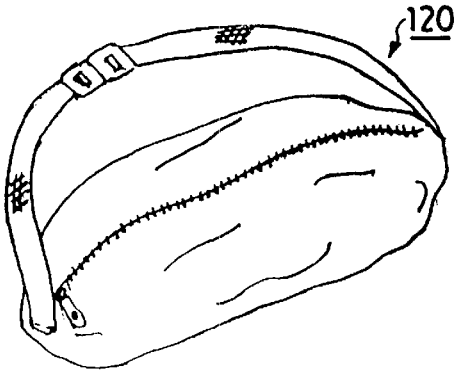
Figure 19:
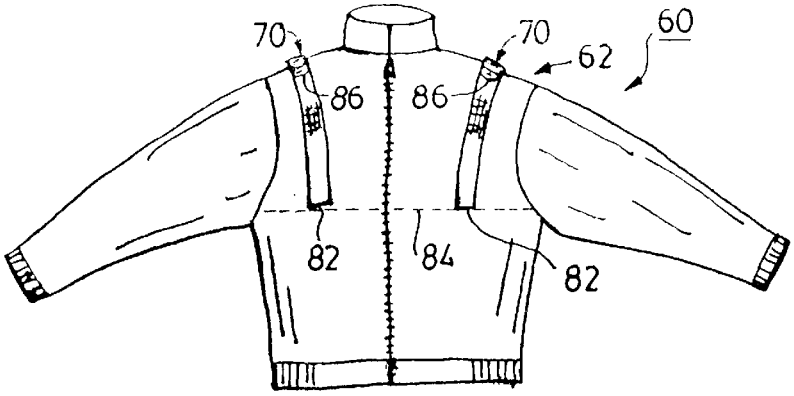
FIG. 19 is a front view of a third embodiment of a convertible garment of the present invention.

The invention comprises, in a still further form thereof, a garment 120 (FIGS. 12–18) which can be configured as either a jacket or a duffel bag. Garment 120 includes a jacket portion 122 and a pocket 124 (FIG. 13). Pocket 124 is formed by attaching a piece of material to the inside back portion 126 of jacket portion 122. Thus, pocket 124 is concealed within jacket portion 122 and is not visible when garment 120 is worn as a jacket. Pocket 124 includes zipper 128 which selectively provides access to the inside of pocket 124. Two straps 130 (FIG. 14) and 132 are attached at opposite ends to an inside surface 134 (FIG. 15) of pocket 124 proximate to zipper 128. Straps 130 and 132 are selectively connected together by buckle 134. To configure garment 120 as a duffel bag, zipper 128 is opened. As shown in FIG. 15–18, pocket 124 is then turned inside out such that inside surface 134 is exposed. Jacket portion 122 is then folded and/or stuffed into pocket 124, whereupon zipper 128 is closed and jacket portion 122 is totally contained within pocket 124. Straps 130 and 132 are then attached together by operating buckle 134. Conversely, to reconfigured garment 120 as a jacket, the process is reversed. More particularly, zipper 128 is opened, and pocket 124 is turned inside out or, alternatively, jacket portion 122 is pulled from within pocket 124. Straps 130 and 132 are then placed into pocket 124 and zipper 128 is closed.

In the embodiments shown, various fastening and closing devices are described with particularity. However, it is to be understood that suitable alternate fastening and closing devices can be used while still achieving the advantages of the present invention.

What is claimed:

1. A convertible garment, comprising:

a jacket portion designed to be worn by a user and having an outer shell with an outside surface and an inside surface, an inner shell or jacket lining, which inner shell is at least substantially concealed from view when the jacket portion is worn by the user, the outer shell and the inner shell further defining an accessible storage space between the outer shell and the inner shell, said inner shell defining an orifice which provides access to said storage space from inside the jacket portion, and fastening means fixed to the inner shell for selectively opening and closing said orifice and concealed from view when the jacket is worn; and a bag portion integral with said jacket portion having an inside and an outside and affixed to the inside surface of the outer shell and disposed to be concealed and stored inside out within the storage space when the jacket is worn and the inner shell orifice is closed, said bag portion having flexible sides which define a bag opening and having a volume sufficient to store at least said jacket portion, a fastener associated with said bag opening and configured for selectively providing access to an interior of said bag portion, said bag portion being configured to be removed from said storage space, turned with its outside out, and receiving said jacket portion within the bag portion to form a duffel bag, with the outer shell of the jacket portion stored between the inner shell and the inside surface of the outer shell with the outside surface of the outer shell hidden from view when the inner shell orifice is closed by the fastening means, and means for carrying the garment as a duffel bag.

2. A convertible garment according to claim 1 wherein the storage space is contained to the back of the user when the garment is worn as a jacket.

3. A convertible garment according to claim 1 wherein the orifice and the bag portion while in the storage space are positioned substantially vertically when the jacket portion is worn by the user, and further comprising second fastening means for detachably connecting the bag portion to the jacket portion at a point that substantially prevents the bag portion from sagging with in the storage space.

4. A convertible garment according to claim 1 wherein the orifice and the bag portion while in the storage space are positioned substantially horizontally when the jacket portion is worn by the user.

5. A garment, comprising:

a jacket portion having two jacket straps attached thereto, each of said jacket straps having a first end and a second end, each said first end being attached at a respective first attachment point to a reinforced seam of said jacket portion, said second end terminating in a first buckle portion, each of said jacket straps being attached to said jacket portion at a second attachment point intermediate said first end and said second end of said jacket straps; and a back pack portion having two back pack straps, each of said backpack straps having a first end and a second end, each said first end being attached at a respective third attachment point to said back pack portion, each said second end being terminated in a second buckle portion, said second buckle portion configured for selectively attaching and detaching with said first buckle portion thereby selectively connecting said jacket straps to said back pack straps, said back pack portion being connected to said jacket portion by a zipper, said back pack portion including folds formed therein, said folds being configured for expanding said back pack portion from a storage configuration to a use configuration wherein said backpack is expanded, at least one strip of hook and loop fastener being disposed in said folds and being configured for removably securing said folds together when said backpack is in said storage position.

6. A garment according to claim 2 and further comprising closure means running substantially the length of and adjacent to the folds for holding the folds in a contracted position when the back pack is in the storage position.

* * * * *